US012637266B2

(12) United States Patent
Nilsson

(10) Patent No.: US 12,637,266 B2
(45) Date of Patent: May 26, 2026

(54) PACKAGE CLOSURE AND A METHOD FOR PRODUCING A PACKAGE CLOSURE

(71) Applicant: Petro-Pack Ab, Ljungby (SE)

(72) Inventor: Hugo Nilsson, Ljungby (SE)

(73) Assignee: Petro-Pack Ab, Ljungby (SE)

( * ) Notice: Subject to any disclaimer, the term of this patent is extended or adjusted under 35 U.S.C. 154(b) by 664 days.

(21) Appl. No.: 17/771,033

(22) PCT Filed: Oct. 21, 2020

(86) PCT No.: PCT/SE2020/051022
§ 371 (c)(1),
(2) Date: Apr. 22, 2022

(87) PCT Pub. No.: WO2021/080497
PCT Pub. Date: Apr. 29, 2021

(65) Prior Publication Data

US 2022/0388741 A1 Dec. 8, 2022

(30) Foreign Application Priority Data

Oct. 24, 2019 (SE) ..... 1951210-2

(51) Int. Cl.
*B65D 47/36* (2006.01)
*B65D 41/48* (2006.01)
(Continued)

(52) U.S. Cl.
CPC ..... *B65D 47/36* (2013.01); *B65D 41/485* (2013.01); *B65D 47/103* (2013.01); *B65D 55/16* (2013.01); *B65D 2547/06* (2013.01)

(58) Field of Classification Search
CPC ..... B29C 45/0055; B29C 45/0081; B29C 45/4407; B29L 2031/56
(Continued)

(56) References Cited

U.S. PATENT DOCUMENTS 4,552,328 A 11/1985 Dutt et al.
2013/0146559 A1* 6/2013 Nilsson ..... B65D 47/10 425/556
(Continued)

FOREIGN PATENT DOCUMENTS

CA 2176921 A1 6/1995
EP 2586721 A1 5/2013
(Continued)

OTHER PUBLICATIONS

International Search Report and Written Opinion corresponding to Application No. PCT/SE2020/051022 mailed Mar. 30, 2021.

*Primary Examiner* — Christina A Johnson
*Assistant Examiner* — Xue H Liu
(74) *Attorney, Agent, or Firm* — Renner, Otto, Boisselle & Sklar, LLP

(57) ABSTRACT

A package closure (10) comprising a neck (12), a cap (11) for closing an opening of the neck (12), and a folded portion (21) connecting the neck (12) and the cap (11), wherein the neck (12) has an axis (A) and is formed with a tubular portion (16) and an inward projecting sealing flange (18), wherein the cap (12) is formed with a top portion (13) for covering the opening of the neck, and an axially extending sealing ring (19) to interact with the sealing flange (18) to form a seal between them. The neck (12), the cap (11) and the folded portion (21) are formed in a single integrated piece. The cap (11) is further formed with an axially extending wall (14) arranged radially outside of the tubular portion (16) of the neck (12), wherein the folded portion (21) connects the wall (14) of the cap (11) with the neck (12). The top portion (13) of the cap (11) is connected to the wall (14) through a breakable notch (23) and a hinge (24), wherein the top portion (13) is openable by tearing along the notch (23)
(Continued)

Figure 1:
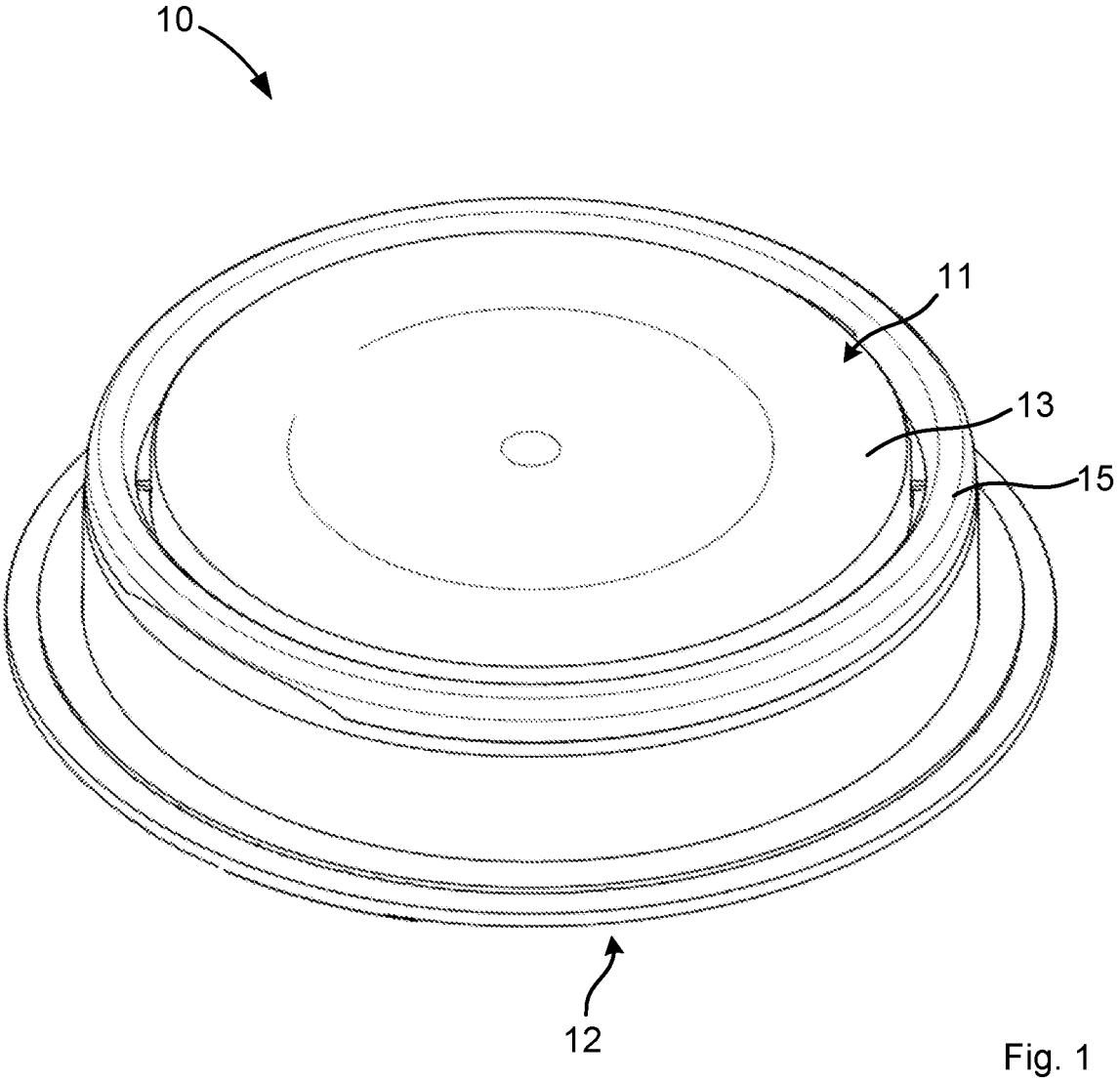

and folding along the hinge (24). Disclosed is also a method for producing the package closure (10).

4 Claims, 14 Drawing Sheets

(51) Int. Cl.
*B65D 47/10* (2006.01)
*B65D 55/16* (2006.01)

(58) Field of Classification Search
USPC ..... 264/334
See application file for complete search history.

(56) References Cited

U.S. PATENT DOCUMENTS

| | | | | |
|---|---|---|---|---|
| 2015/0284149 | A1* | 10/2015 | Nilsson | B65D 41/3428 29/283 |
| 2017/0259494 | A1* | 9/2017 | Nilsson | B29C 45/006 |

FOREIGN PATENT DOCUMENTS

| | | | |
|---|---|---|---|
| GB | 1350989 | A1 | 4/1974 |
| KR | 20000010638 | A1 | 2/2000 |
| LU | 88851 | A1 | 3/1997 |
| WO | 9414588 | A1 | 7/1994 |
| WO | 0056612 | A1 | 9/2000 |
| WO | 2012033451 | | 3/2012 |
| WO | 2014088500 | A1 | 6/2014 |

* cited by examiner

PACKAGE CLOSURE AND A METHOD FOR PRODUCING A PACKAGE CLOSURE

This application is a national phase of International Application No. PCT/SE2020/051022 filed Oct. 21, 2020, which claims priority to Swedish Application No. 1951210-2 filed Oct. 24, 2019, the entire disclosures of which are hereby incorporated by reference.

FIELD OF THE INVENTION

The present invention relates to package closures and a method for producing a package closure. One type of such package closures comprises a neck (also called spout), a cap for closing an opening of the neck, and a folded portion connecting the neck and the cap, wherein the neck has a centre axis and is formed with an axially extending tubular portion and an inward projecting sealing flange, wherein the cap is formed with a radially extending top portion for covering the opening of the neck, and an axially extending sealing ring to interact with the sealing flange to form a seal between them, and wherein the neck, the cap and the folded portion are formed in a single integrated piece. Package closures of this type are arranged in plastic materials and have inherent flexible properties, such as thermoplastic materials or other plastic materials having similar properties. Package closures of this type are generally used for packages for liquid foodstuff, such as milk, juice, water, yoghurt and similar but can be used also for other types of packages. Packages of this type are generally used for packages of carton or a combination of carton and plastic materials or other materials, such as flat top carton packages or gable top carton packages, which, for example, can be folded from a blank, wherein the package closure is fastened to the package.

Another type of such package closures is arranged for closing an opening of a neck, such as a bottle neck, wherein the package closure is a cap comprising a centre axis, a radially extending top portion, an axially extending wall and a folded portion, wherein the package closure is formed in a single integrated piece. Package closures of this type are also arranged in plastic materials and have inherent flexible properties, such as thermoplastic materials or other plastic materials having similar properties. Package closures of this type are generally used for packages for liquid foodstuff, such as milk, juice, water, yoghurt and similar but can be used also for other types of packages. Packages of this type are generally in the form of bottles, such as plastic bottles.

PRIOR ART

A plurality of different types of package closures and caps is disclosed in the prior art. One type of such prior art package closure is disclosed in WO2012/033451. This document discloses a package closure having a neck, a cap for closing the neck, and a folded portion between the neck and cap, wherein the cap is connected to the neck through a breakable notch, and wherein the package closure can be formed in one integral piece of plastic material.

However, there is a need to improve such package closures and provide reliable and user-friendly package closures of plastic materials, which are easy to produce and which can replace many other package closures used today with reduced material consumption.

BRIEF DESCRIPTION OF THE INVENTION

One object of the present invention is to overcome or at least alleviate the above-mentioned problems and provide a more The present invention relates to a package closure for closing an opening of a neck, comprising a centre axis, a radially extending top portion and an axially extending wall, wherein the package closure is formed in a single integrated piece, wherein the package closure is formed with an axially extending sealing ring arranged radially inside of the wall, and wherein the top portion of the cap is connected to the wall through a breakable notch and a hinge, wherein the top portion is openable by tearing along the notch and folding along the hinge.

According to a first aspect the package closure can be formed with a cap and a neck, wherein the neck is connected to the cap through a folded portion. Hence, the present invention according to the first aspect is related to a package closure comprising a neck, a cap for closing an opening of the neck, and a folded portion connecting the neck and the cap, wherein the neck has a centre axis and is formed with an axially extending tubular portion and an inward projecting sealing flange, wherein the cap is formed with a radially extending top portion for covering the opening of the neck, and an axially extending sealing ring to interact with the sealing flange to form a seal between them, and wherein the neck, the cap and the folded portion are formed in a single integrated piece, characterised in that the cap is further formed with an axially extending wall arranged radially outside of the tubular portion of the neck, wherein the folded portion connects the wall of the cap with the neck, and the top portion of the cap is connected to the wall through a breakable notch and a hinge, wherein the top portion is openable by tearing along the notch and folding along the hinge. The configuration of the package closure makes it possible to provide a reliable and user-friendly package closure of plastic material, which can be produced in an efficient manner. For example, the cap of the package closure has a snap-lock lid formed by the top portion. The snap-lock function for detachably fastening the top portion in the closed position after opening can be arranged in a conventional manner, such as by protrusions or protrusions and indentations interacting with each other due to the inherent flexible properties of the material of the package closure. The cap can be provided with a pull-ring to facilitate opening thereof.

The folded portion can connect a top end of the neck and a bottom end of the wall of the cap, wherein an efficient seal and tamper seal is provided while the entire package closure is formed in one integrated piece in an efficient manner.

The breakable notch can be formed with a start area to facilitate opening of the package closure. Reinforcements can be arranged on one or both sides of the start area to provide a short stop during opening, so that only the start area is opened first to even out any pressure difference between the inside and outside of the package before the rest of the breakable notch is broken. This has been found to provide an efficient opening of packages containing carbonated liquids, as any elevated pressure due to the carbonated liquid is let out in a smooth manner before breaking the entire notch.

The neck can be formed with an attachment portion and the cap can be formed with a fixing portion to be melted together with the package and the attachment portion when the package closure is fixed to a package. Hence, the cap is fixed to the neck with the folded portion in the folded position to provide a reliable and easy-to handle package closure and to provide improved fastening of the package closure to the package by welding, melting or similar conventional fastening methods.

The package closure can be formed with a lever ring connected to the sealing ring, wherein the lever ring and sealing ring are connected to the wall through a radially extending portion to form a leverage line between the sealing ring and lever ring. Hence, when the pressure inside the package is elevated it is believed that the top portion is bent outward, wherein the lever ring is forced inward around the leverage line to turn the sealing ring outward around the leverage line and improve the sealing effect further.

The present invention is also related to a method for producing a package closure having an axis, a neck, a cap and a folded portion connecting the neck and the cap, comprising the steps of a) by means of movable jaws and a tool core forming the neck the cap and a foldable portion connecting the neck and cap in a single integrated piece, wherein an interior of the neck, an inward projecting sealing flange of the neck, an interior of the foldable portion and an interior of a wall of the cap is formed by an outer first tool core part, wherein the interior of a top portion of the cap and an interior of a sealing ring of the cap is formed by an inner second tool core part, and wherein a breakable notch and a hinge are formed between the top portion and the wall of the cap by the movable jaws and the outer tool core, b) removing the jaws from the formed package closure, c) axially displacing the first tool core part in relation to the second tool core part, thereby disengaging the cap from the second tool core part while keeping the second tool core part engaged with the cap, d) displacing the neck axially in relation to the cap while folding the foldable portion to the folded portion through an inherent flexibility of the package closure, wherein the wall is brought to enclose a tubular portion of the neck and the sealing ring is engaging the sealing flange, e) displacing the package closure in relation to the second tool core part to disengage the package closure from the tool core.

According to a second aspect of the present invention the package closure can be formed to be mounted on the neck of a package, such as a bottle. Then, the package closure is only formed as a cap, i.e. without the neck. The package closure can then be formed with a folded portion being folded inward from the wall to form a lock when pushed over an exterior flange of the package neck. The sealing ring can then be formed with the sealing flange extending radially outward to engage the interior of the package neck. The package closure according to the second aspect can be formed with the pull ring, breakable notch, start area, reinforcements and/or lever ring as described above.

The package closure can be arranged to be attached to a package in a manner that it will not come off unintentionally. Also, the package closure can be arranged to stay as one integral piece also after use. For example, the hinge of the top portion, and also a hinge to the pull-ring, can be formed, so that they are not easily broken to avoid unintentional removal of the pull-ring and/or top portion. Hence, the package closure is arranged to be fixed to the package and to stay in one piece throughout its lifetime.

Further characteristics and advantages of the present invention will become apparent from the description of the embodiments below, the appended drawings and the dependent claims.

SHORT DESCRIPTION OF THE DRAWINGS

Figure 2:
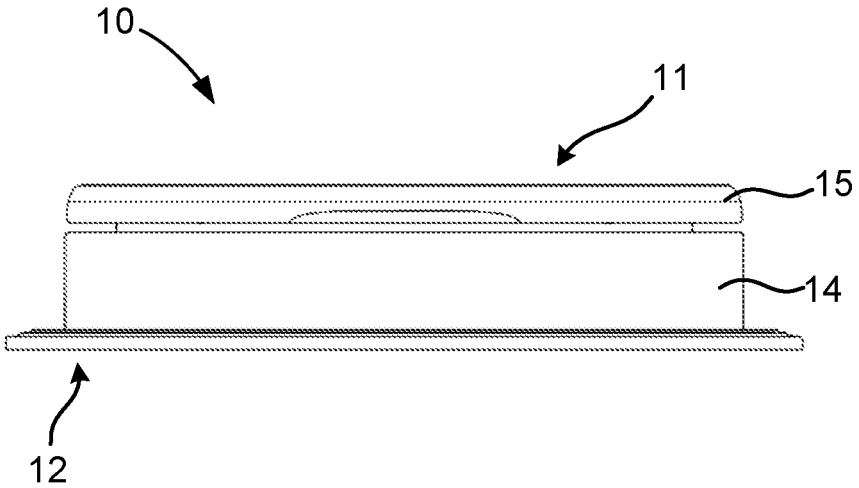
Figure 3A:
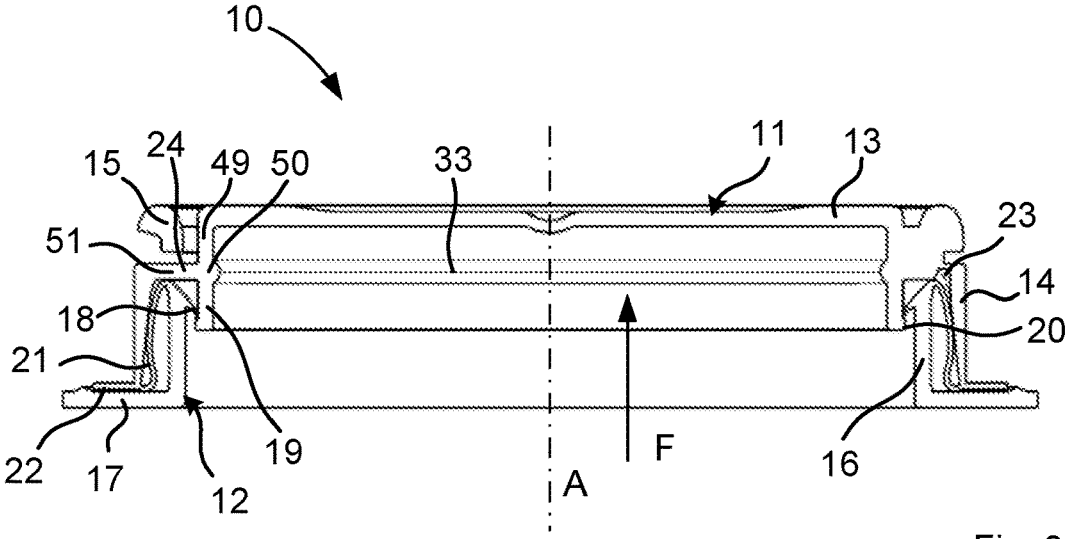
Figure 3B:
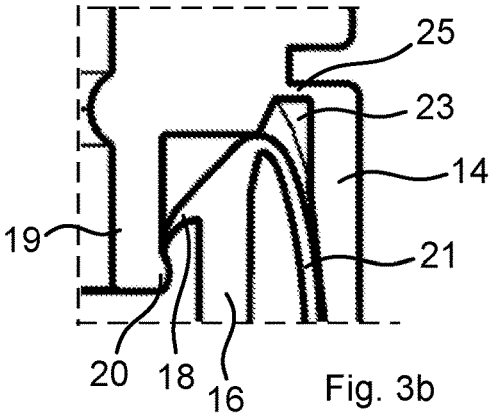
Figure 3C:
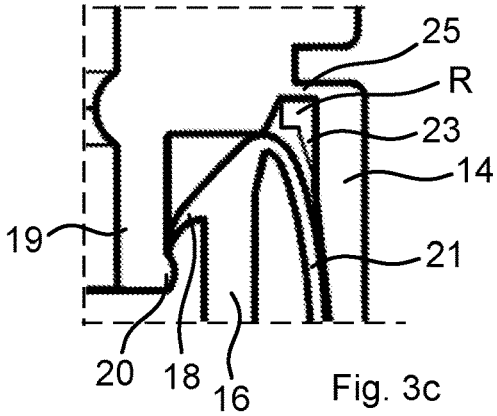
Figure 4:
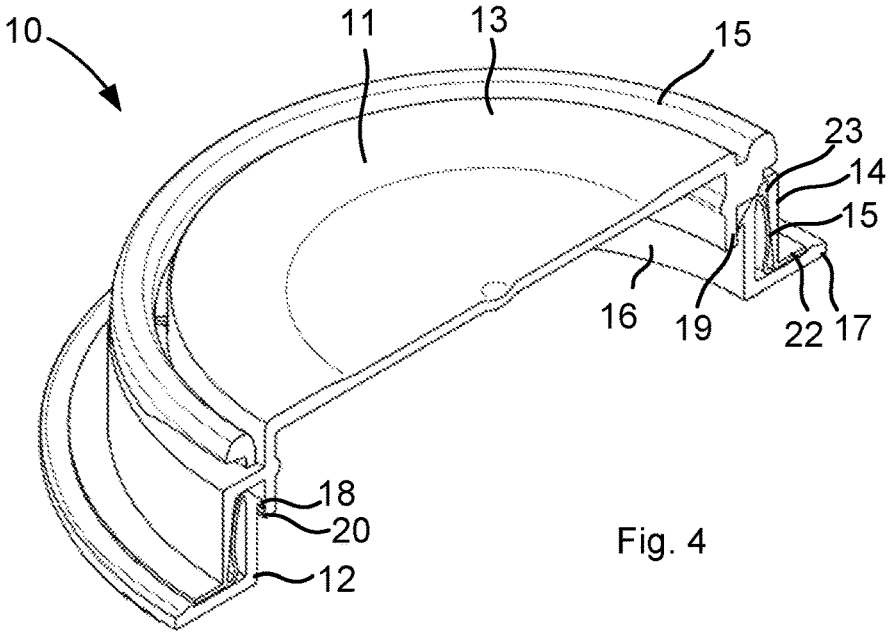
Figure 5:
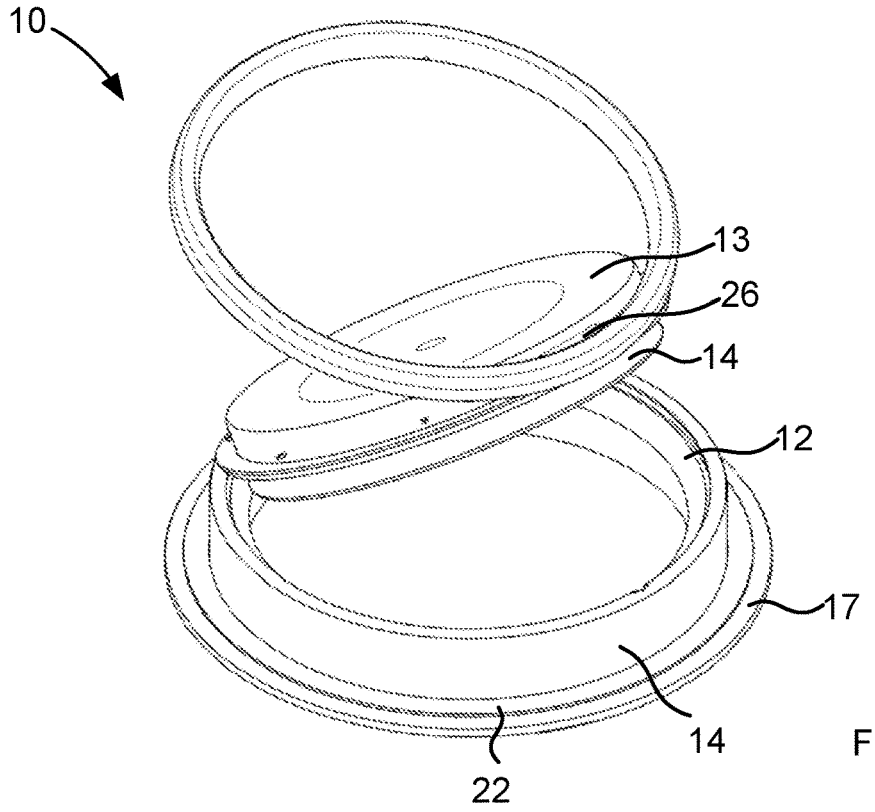
Figure 6:
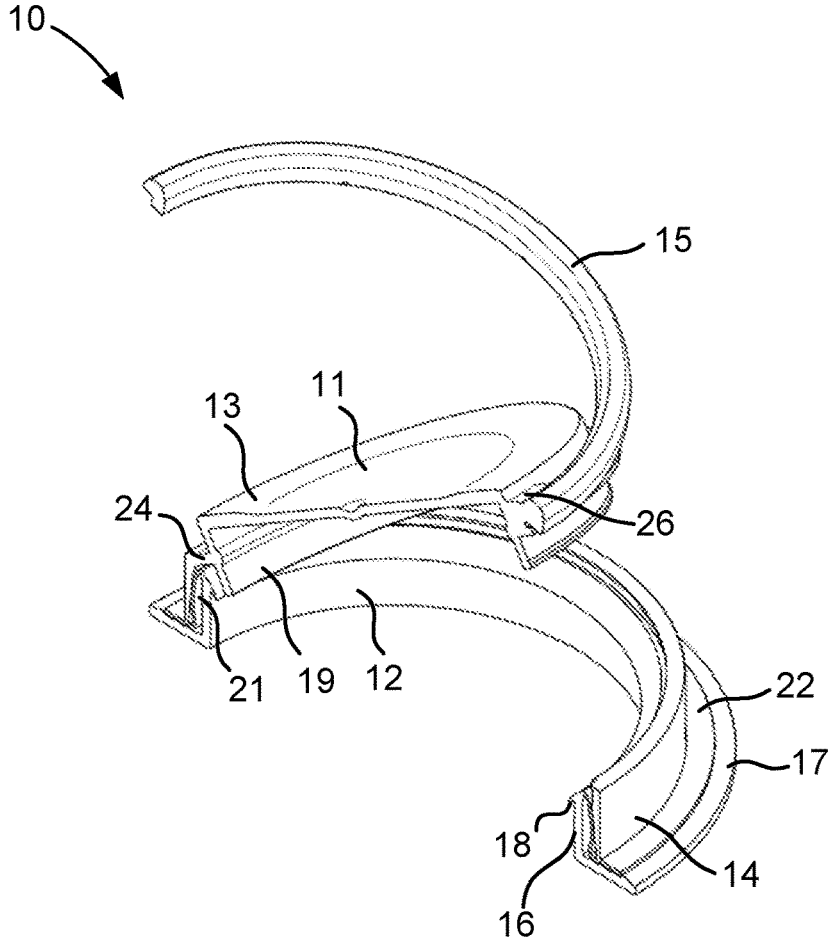
Figure 7:
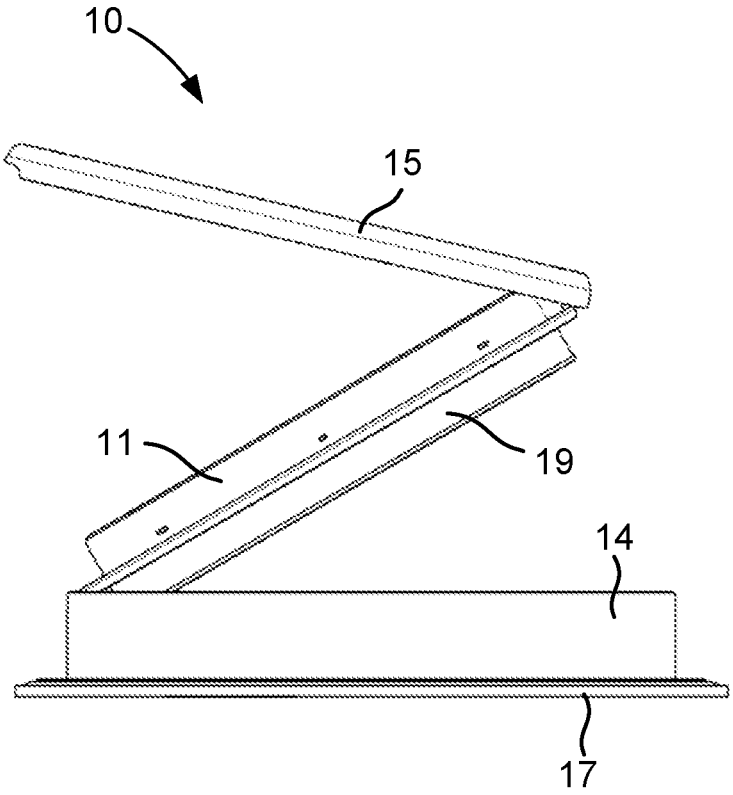
Figure 8:
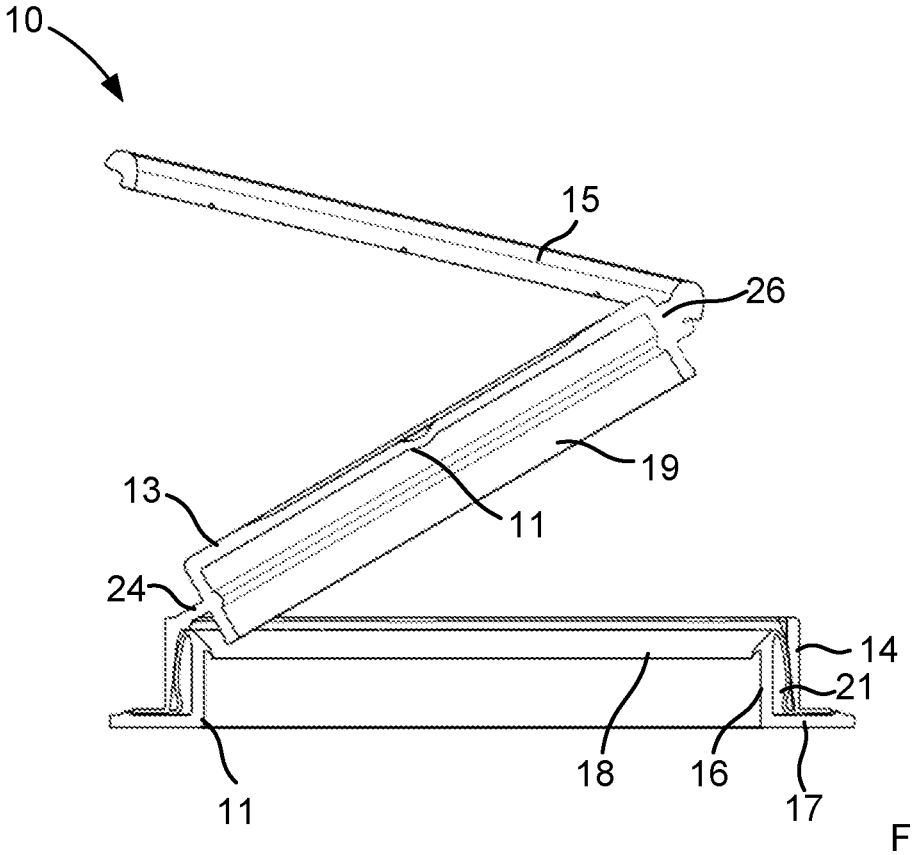
Figure 9:
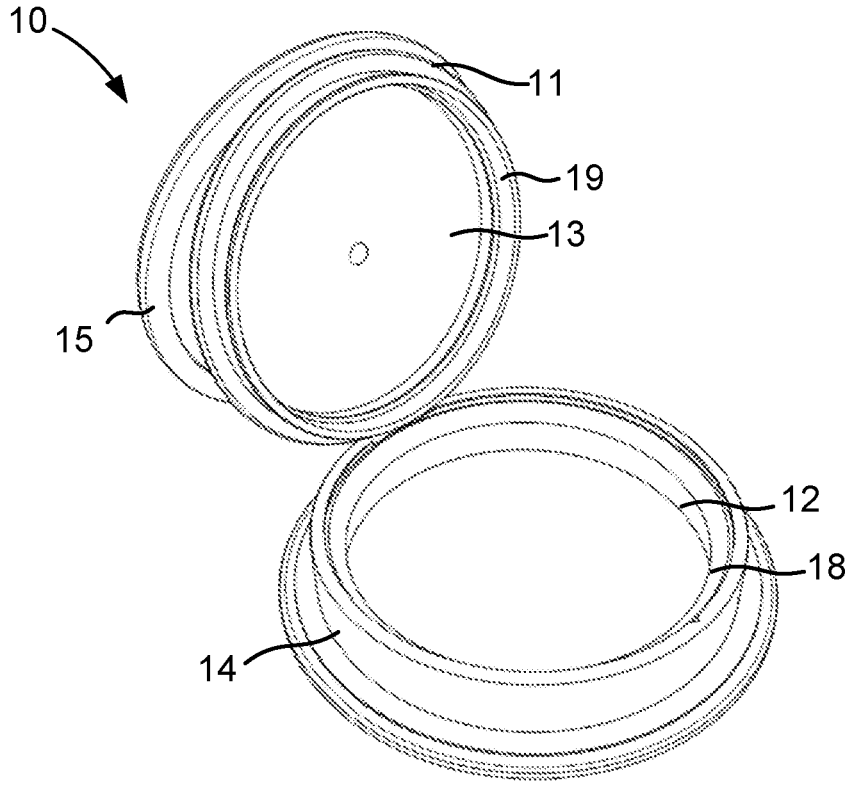
Figure 10:
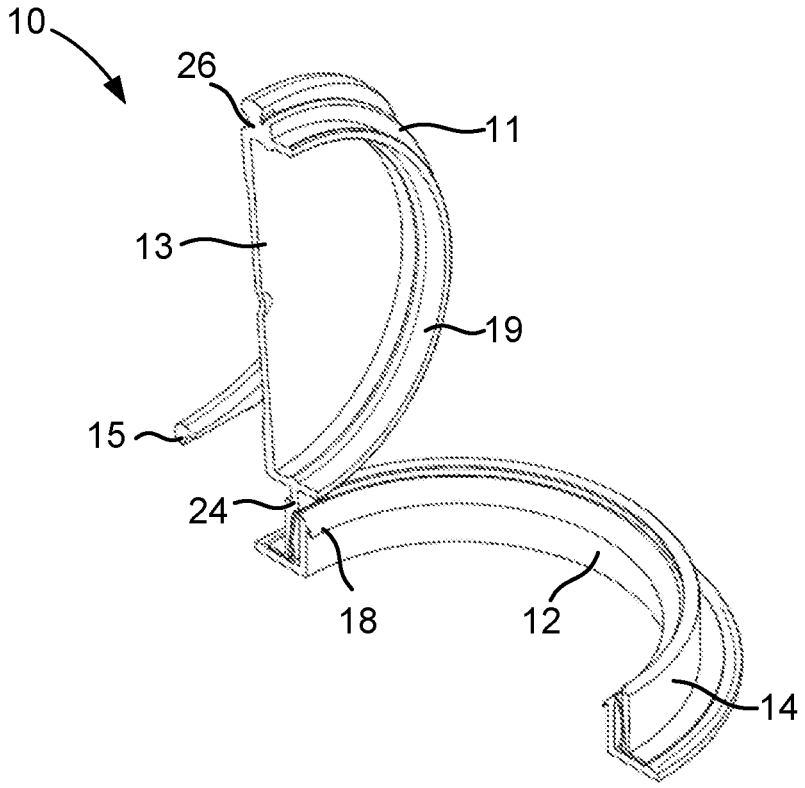
Figure 11:
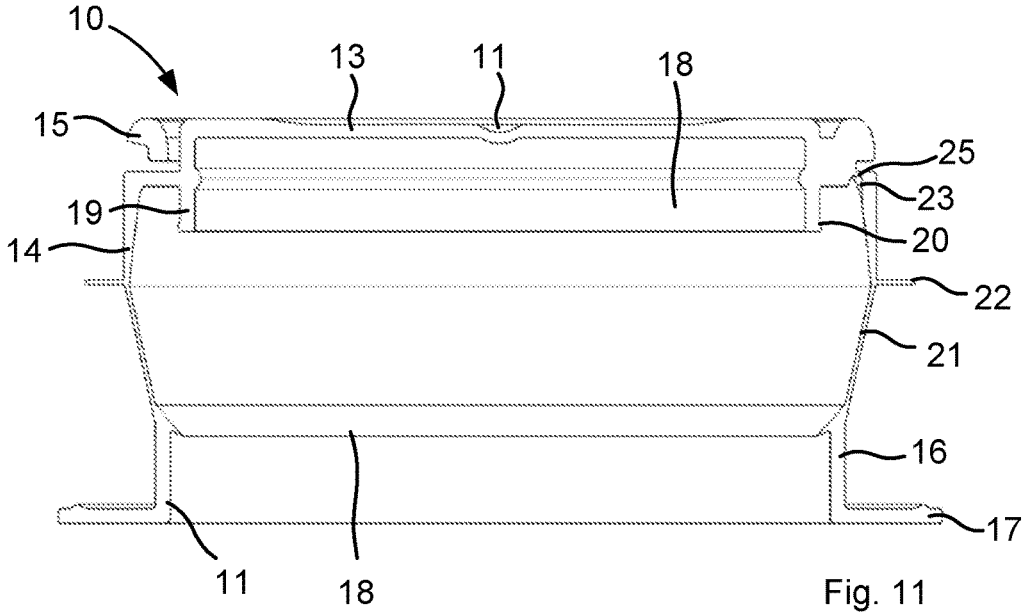
Figure 12:
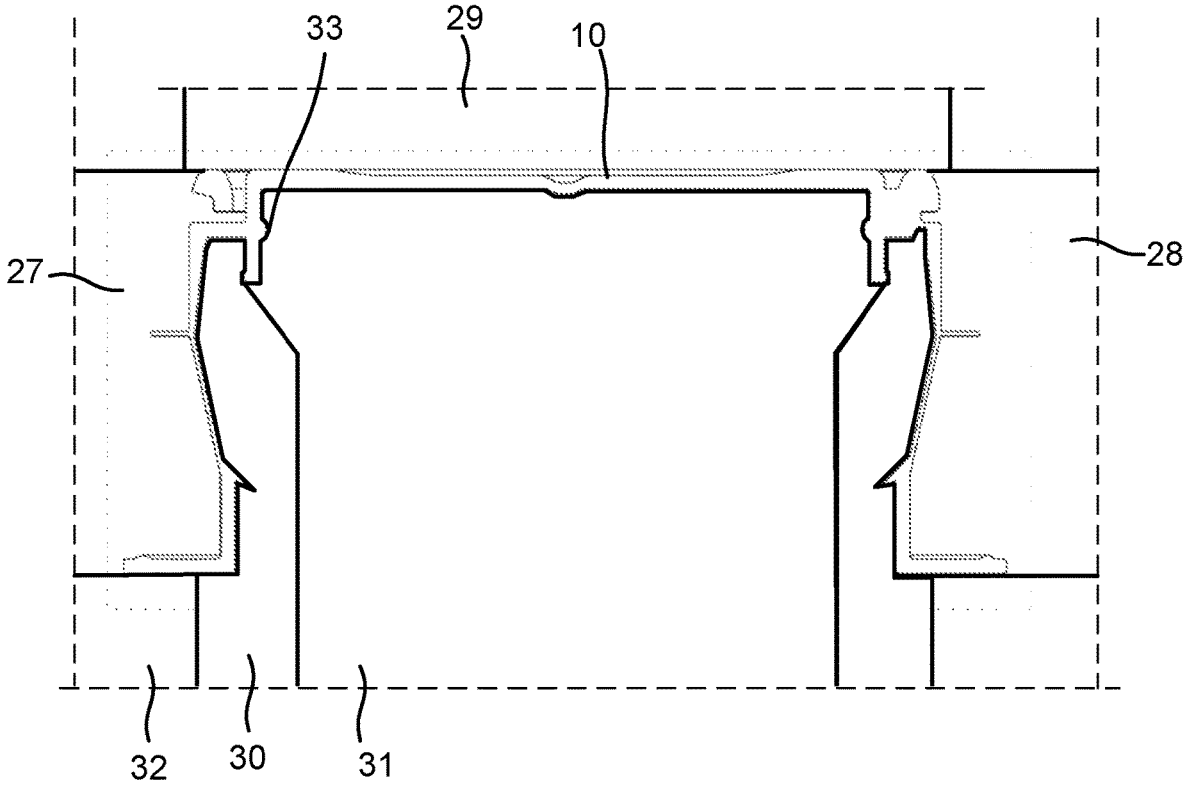
Figure 13:
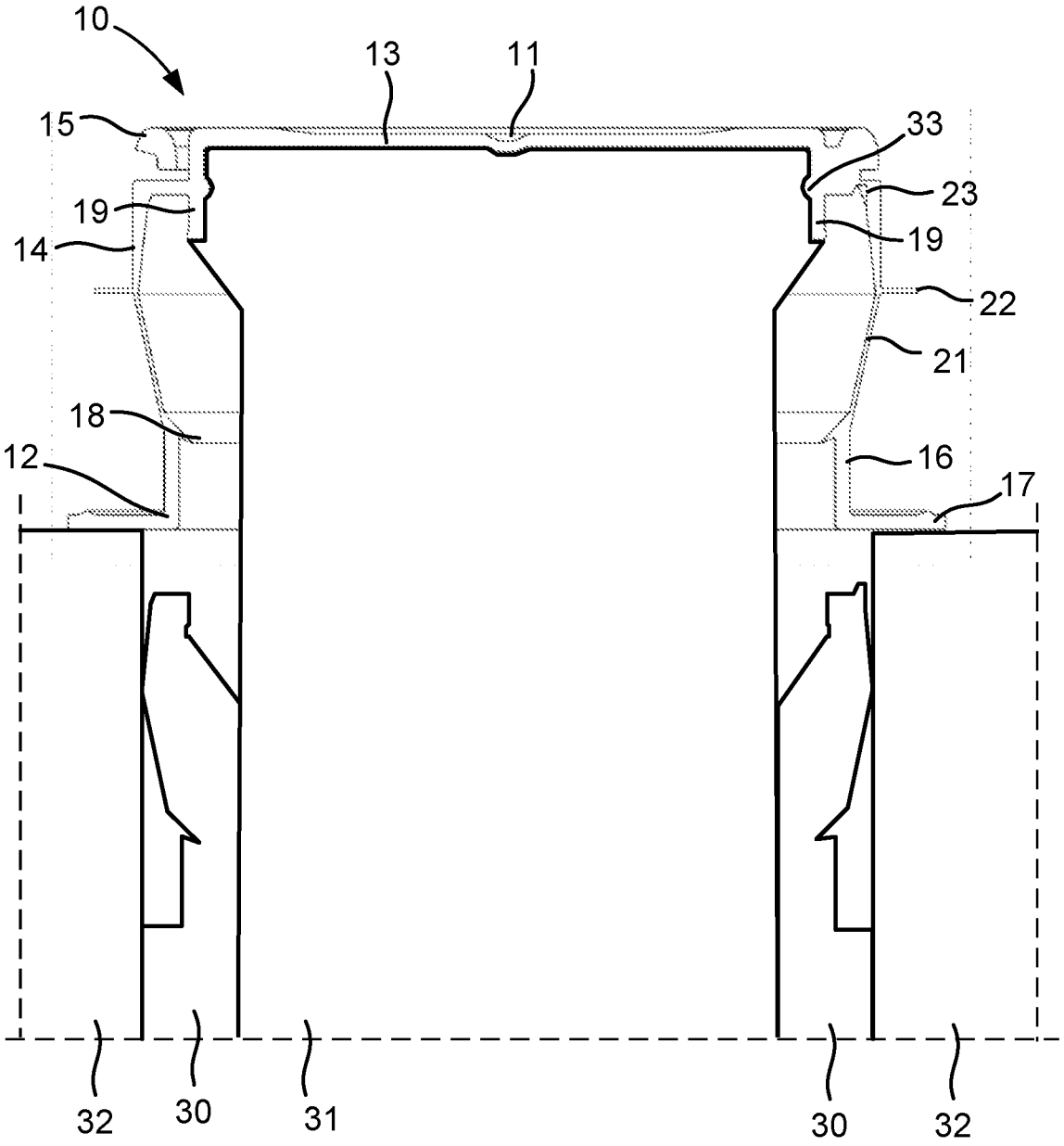
Figure 14:
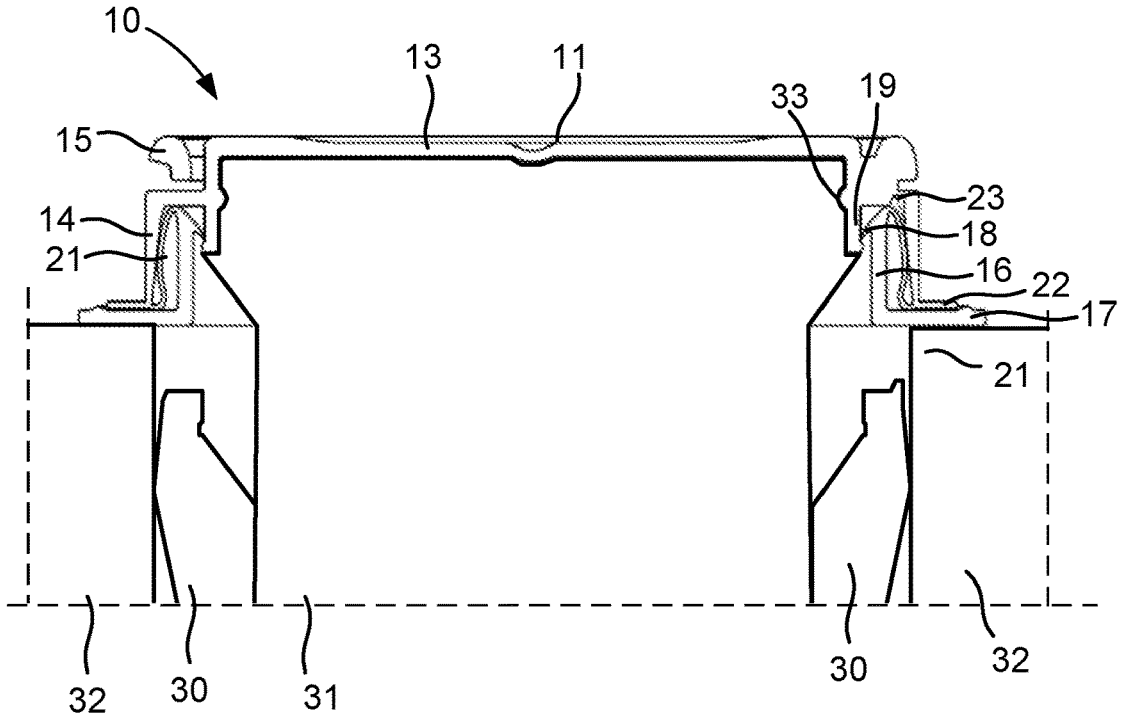
Figure 15:
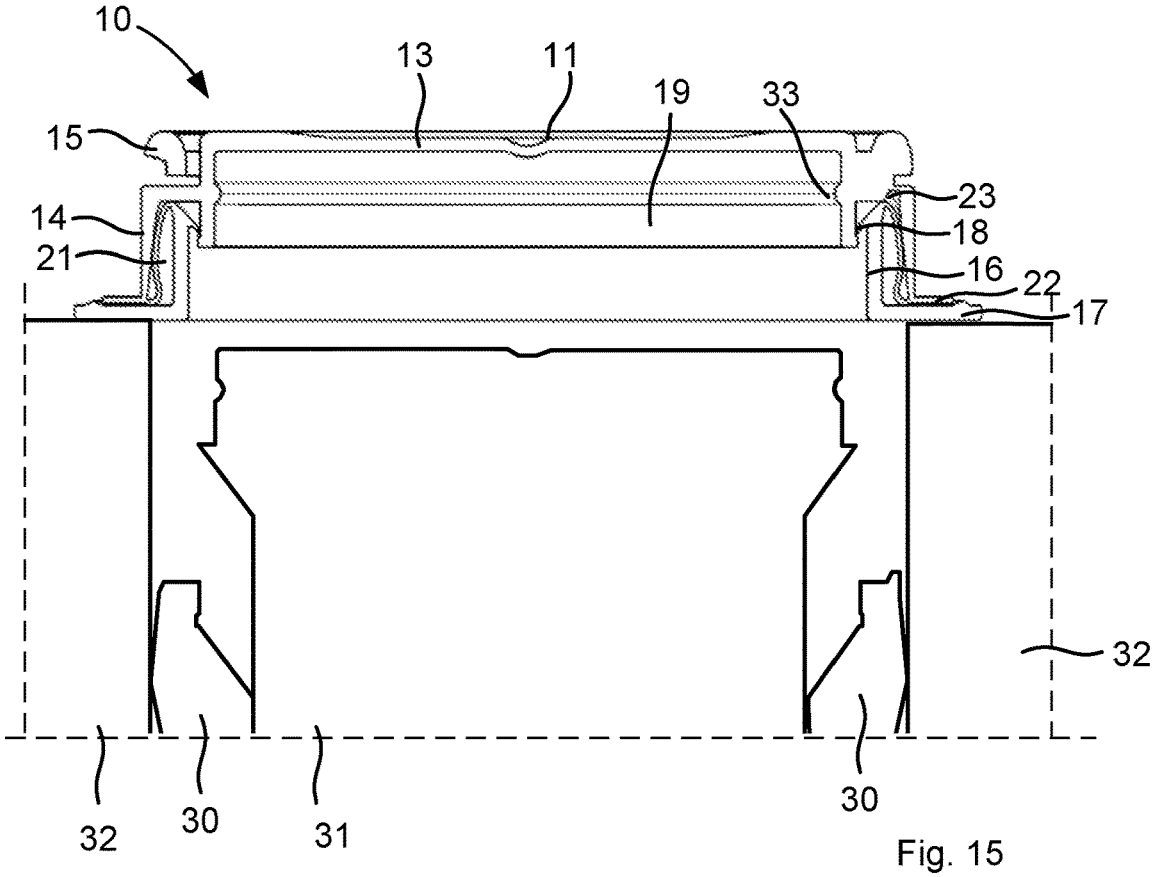
Figure 16:
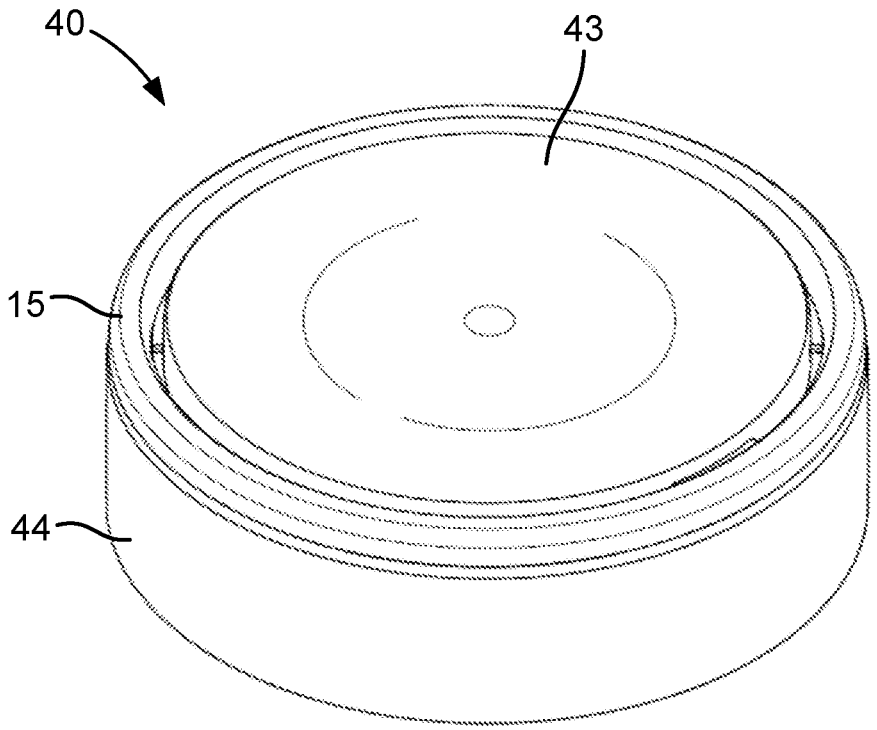
Figure 17:
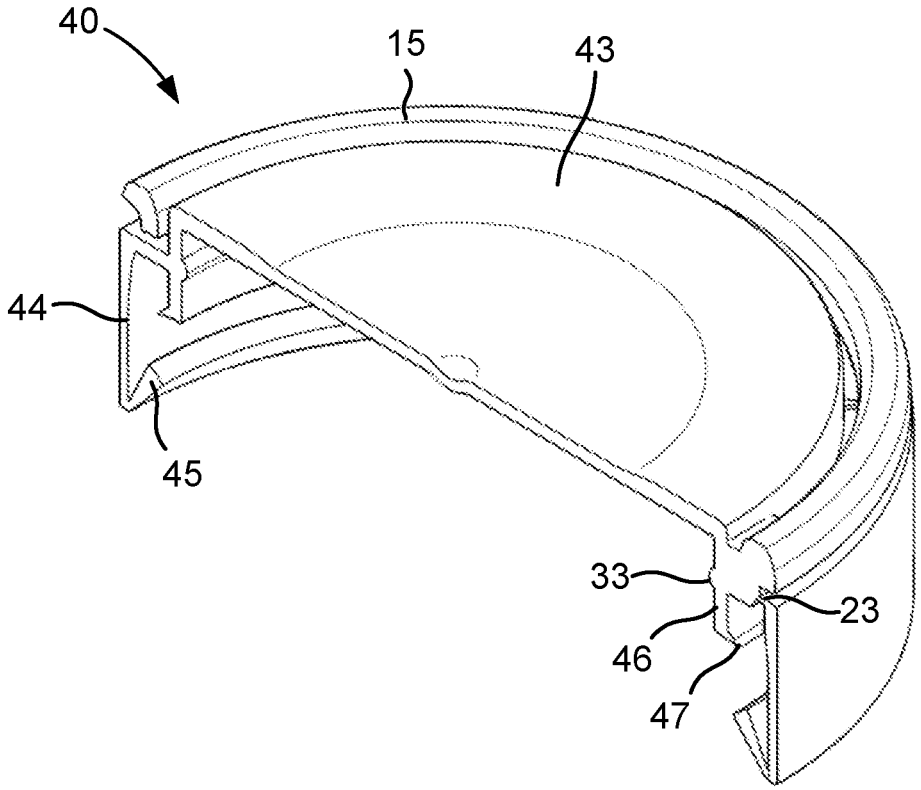
Figure 18:
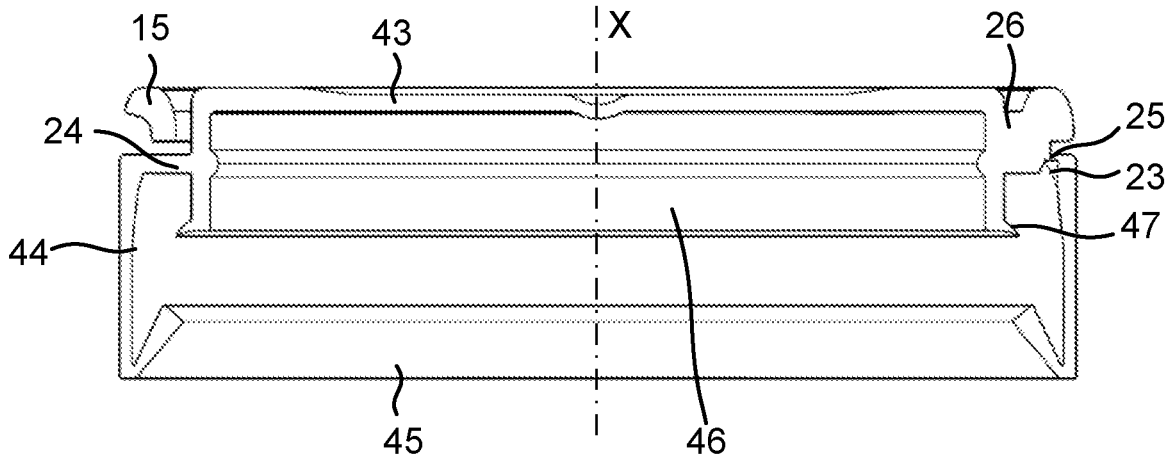
Figure 19:
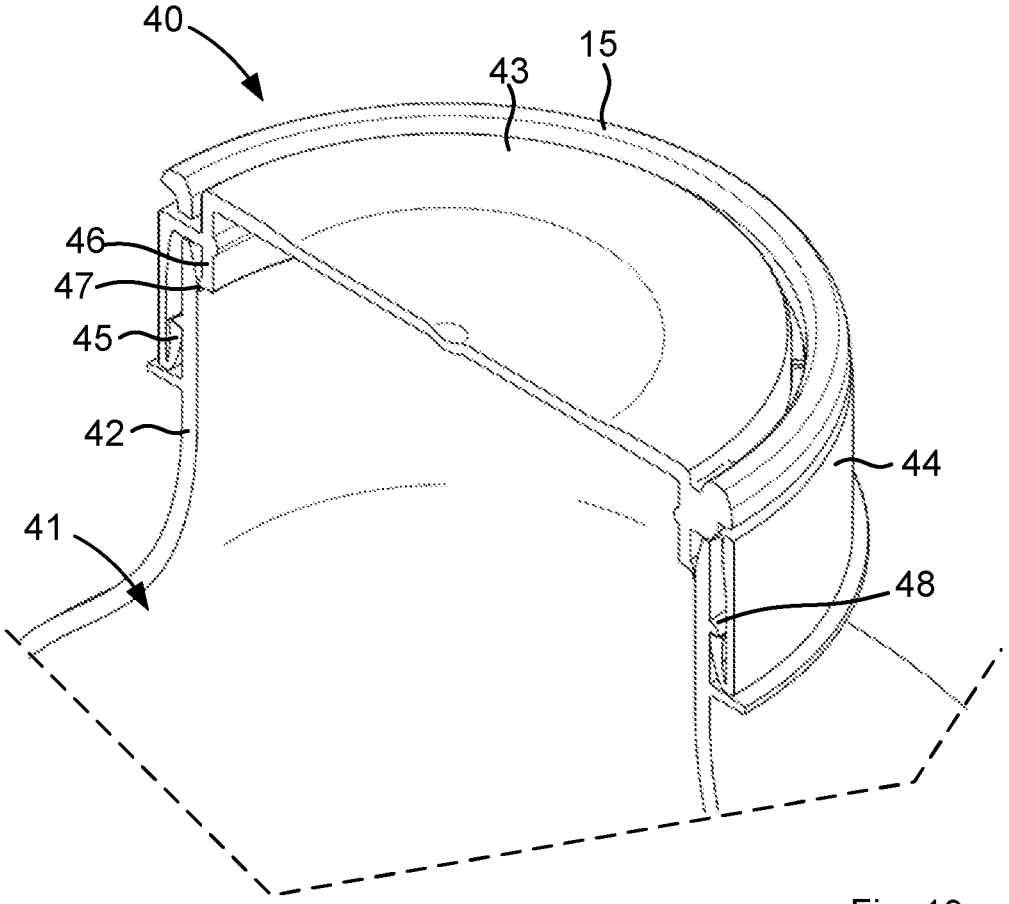
Figure 20:
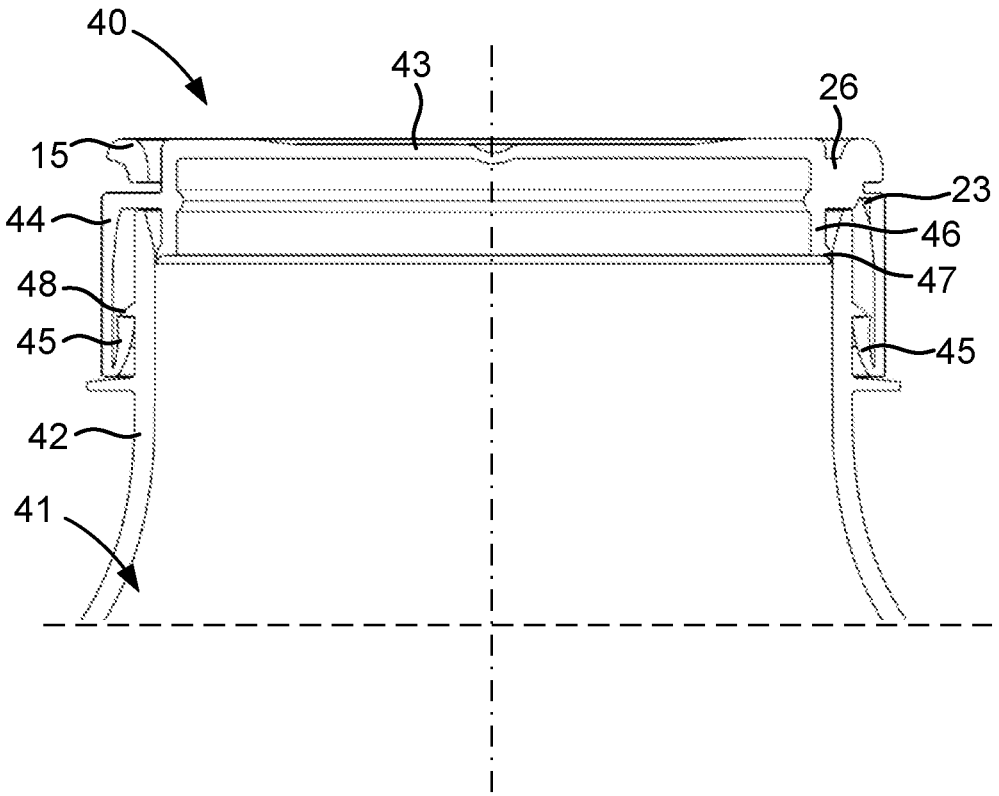
Figure 21:
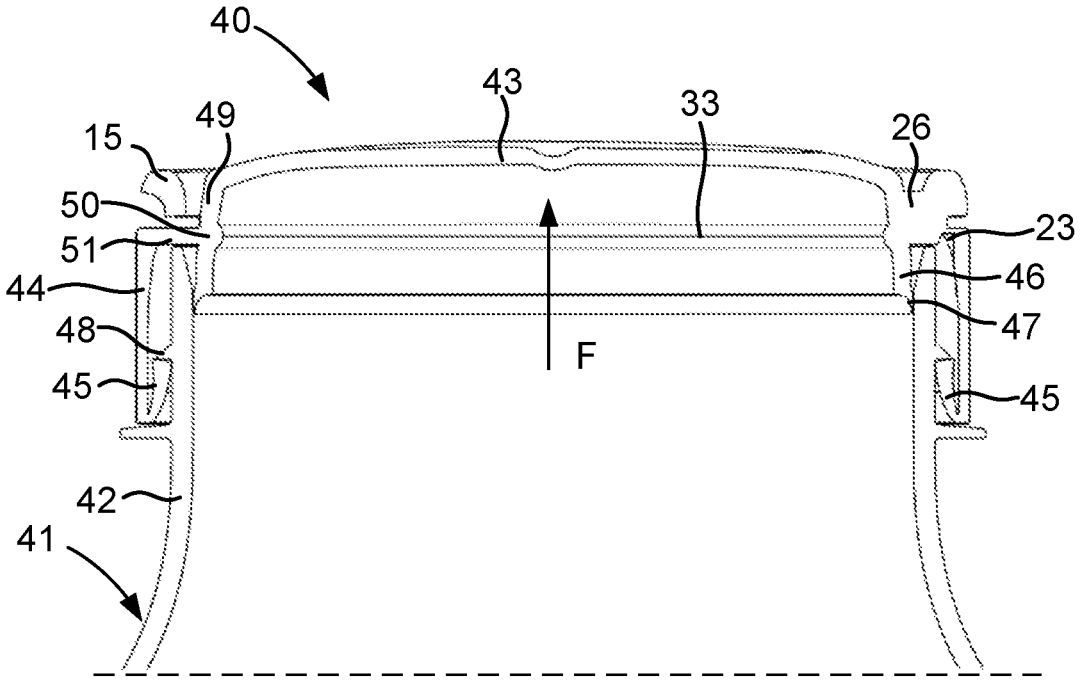
Figure 22:
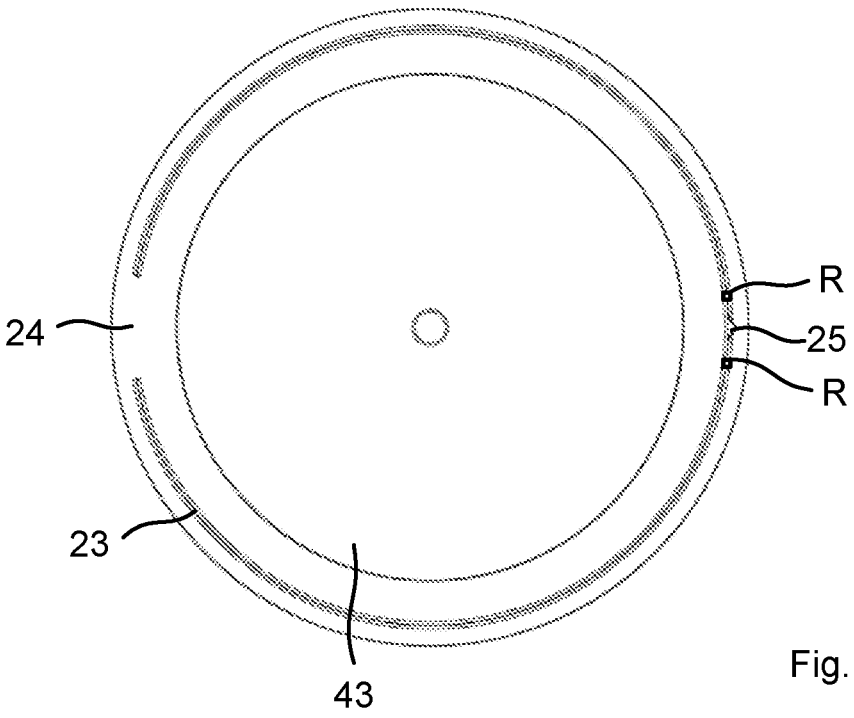
Figure 23:
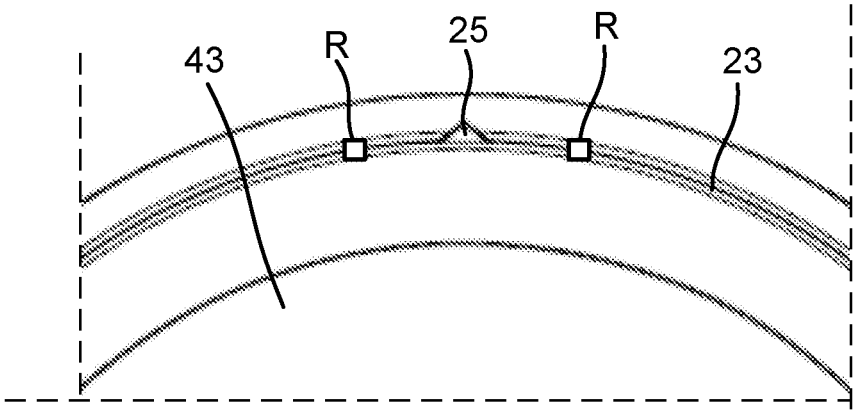
Figure 24:
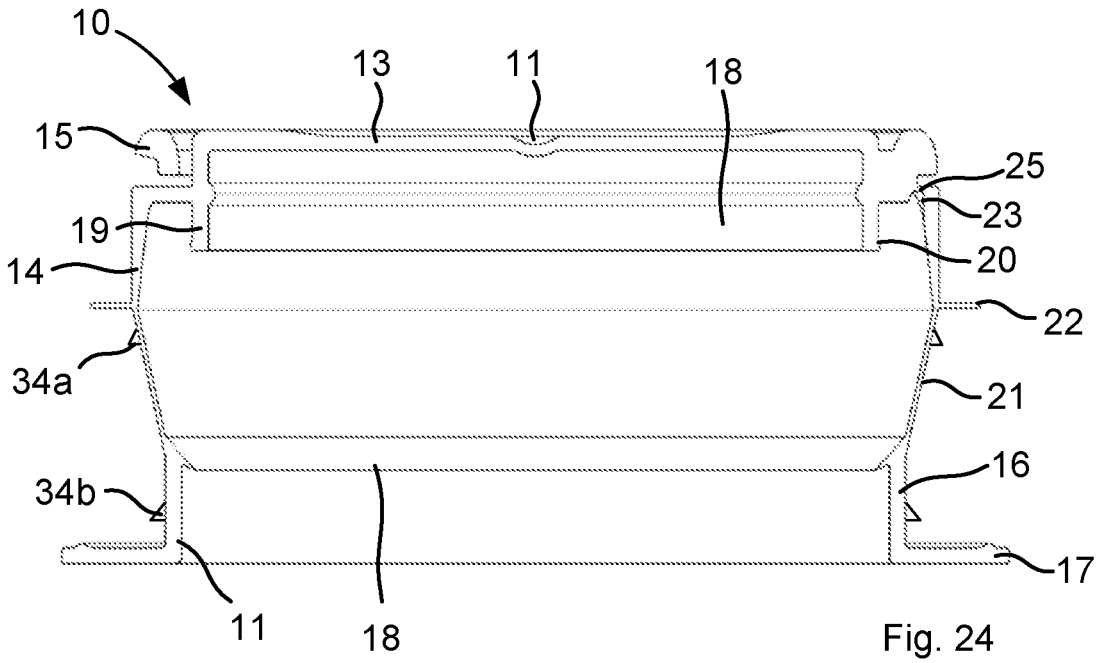
Figure 25:
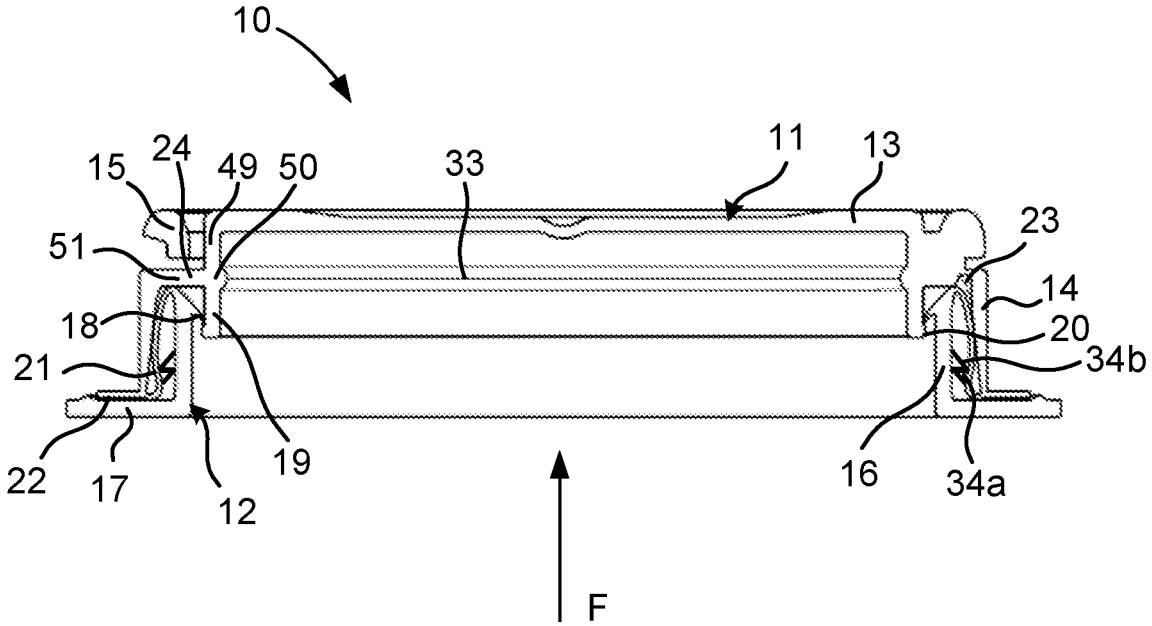
Figure 26:
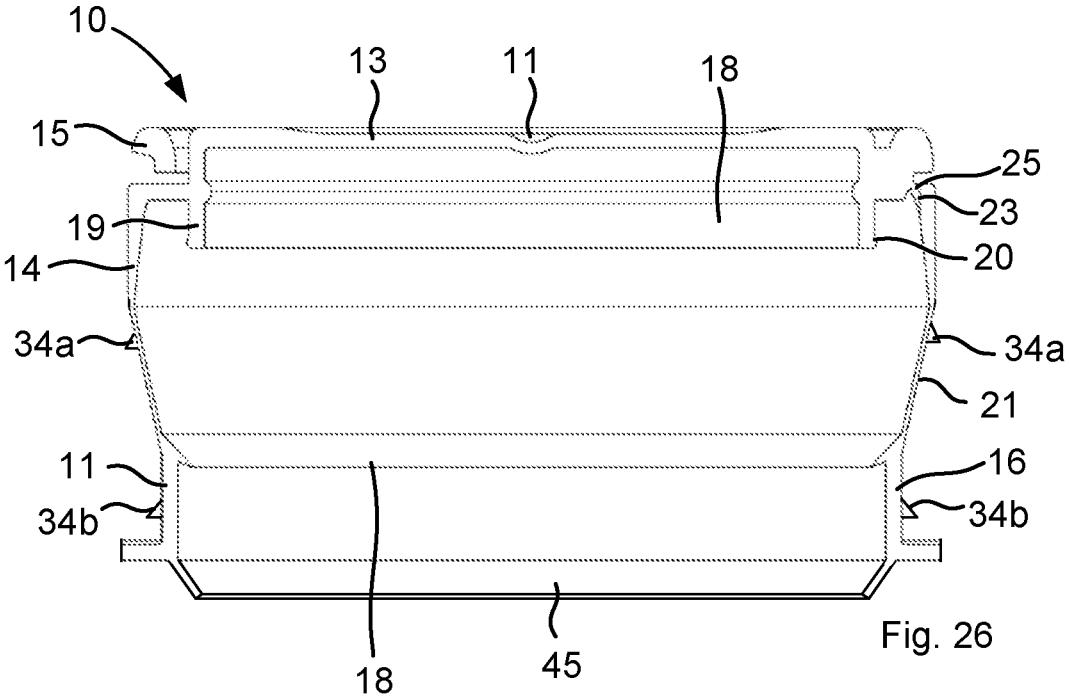
Figure 27:
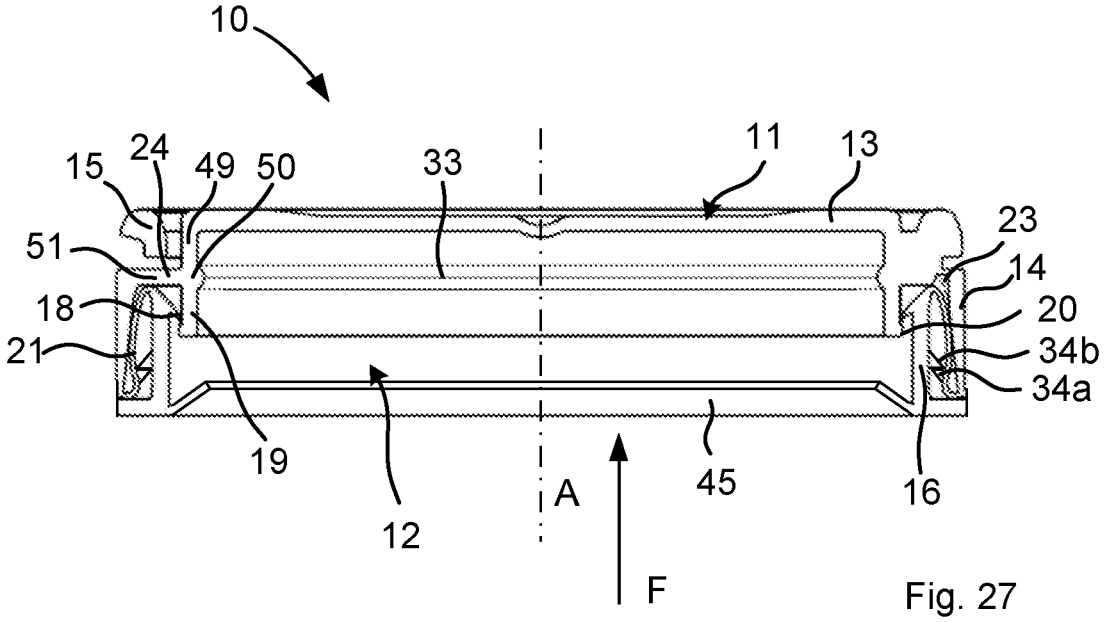

The invention will now be described more in detail with the aid of embodiment examples and with reference to the accompanying drawings, in which FIG. 1 is a schematic perspective view from above of a package closure according to one embodiment, FIG. 2 is a schematic side view of the package closure of FIG. 1, FIG. 3*a* is a schematic section view of the package closure according to one embodiment, FIG. 3*b* is a view of a part of the package closure of FIG. 3*a*, FIG. 3*c* is a view of a part of the package closure according to another embodiment, FIG. 4 is a schematic perspective view of the package closure of FIG. 3, FIG. 5 is a schematic perspective view from above of the package closure according to one embodiment, wherein the package closure is open, FIG. 6 is a schematic section view of the package closure of FIG. 5, FIG. 7 is a schematic side view of the open package closure according to one embodiment, FIG. 8 is a schematic section view of the package closure of FIG. 7, FIG. 9 is a schematic perspective view of the open package closure according to one embodiment, FIG. 10 is a schematic section view of the package closure of FIG. 9, FIG. 11 is a schematic section view of a semi-finished package closure according to one embodiment, FIG. 12 is a schematic section view of a part of a device for producing the package closure according to one embodiment, illustrating the device in a first position for forming the package closure and the semi-finished package closure inside the device, FIG. 13 is a schematic section view of the device of FIG. 12 in a second position, FIG. 14 is a schematic section view of the device of FIG. 12 in a third position, wherein the package closure is finished, FIG. 15 is a schematic section view of the device of FIG. 12 in a fourth position, wherein the finished package closure is ejected from the device, FIG. 16 is a schematic perspective view of to package closure according to another embodiment, FIG. 17 is a schematic section view of the package closure of FIG. 16, FIG. 18 is another schematic section view of the package closure of FIG. 16, FIG. 19 is a schematic perspective view in section of the package closure mounted on a bottle neck, FIG. 20 is a schematic section view of the package closure mounted on a bottle neck, FIG. 21 is a schematic section view of the package closure mounted on a bottle neck, illustrating the package closure under pressure from a content of the bottle, FIG. 22 is a schematic cross section view from below, illustrating a breakable notch having a start area and reinforcements according to one embodiment, FIG. 23 is a schematic detail view of a part of FIG. 22, FIG. 24 is a schematic section view of a semi-finished package closure according to another embodiment, FIG. 25 is a schematic section view of the finished package closure of FIG. 24, FIG. 26 is a schematic section view of a semi-finished package closure according to yet another embodiment, and FIG. 27 is a schematic section view of the finished package closure of FIG. 26.

THE INVENTION

With reference to FIGS. 1-4 a package closure 10 is illustrated according to one embodiment. The package closure 10 is arranged to be fitted to a package, such as a package for liquid foodstuff, such as milk, juice, water, yoghurt and similar or other materials. For example, the package closure 10 is arranged to be attached to a package of plastic material, a combination of carton and plastic material, carton or similar, such as flat top carton packages or gable top carton packages (which generally contain a combination of carton and plastic materials to be liquid-proof). The package is arranged in plastic material and have inherent flexible properties. For example, the package closure is made of thermoplastic materials or other plastic materials having similar properties. The package closure is made in a single integrated piece of plastic material, such as thermoplastic material. For example, the package closure 10 is made in a single integrated piece by moulding, such as injection moulding. According to one example, the package closure 10 has a weight of 1.2-2 g, such as 1.4-1.8, 1.4-1.6 or 1.4-1.5 g. The height of the package closure 10 is, e.g. 6-10 mm, such as 7-9 mm or 8 mm.

The package closure 10 comprises a longitudinal centre axis A, a cap 11 and a neck 12 (also called spout) forming an opening for pouring out the content of the package, wherein the cap 11 is arranged for closing the opening of the neck 12 when the package closure 10 is in a closed position as illustrated in FIGS. 1-4. The cap 11 is formed with a radially extending top portion 13 for covering the opening of the neck 12 when the package closure 10 is in the closed position. The cap 11 further comprises an axially extending wall 14 connected to the top portion 13. The cap 11 is formed with a pull-ring 15 for opening of the package closure 10, which is described more in detail below. For example, the package closure 10 is formed so that the wall 14 forms a diameter of 25-40 mm, such as 30-35 mm or 32 mm.

With reference particularly to FIGS. 3*a*, 3*b* and 4 the neck 12 is formed with an axially extending tubular portion 16. A centre axis of the neck 12 is the same as the centre axis A of the package closure 10. In the illustrated embodiment, the package closure 10 is formed substantially as a circular cylinder, wherein the tubular portion 16 of the neck 12 and the wall 14 of the cap 11 are formed with a circular cross-section. Alternatively, the package closure 10 is formed with an oval, substantially rectangular, triangular or other suitably shaped cross-section, e.g. with rounded corners. The neck 12 is formed with an attachment portion 17 for attachments to the package, such as by melting or welding a part of the attachment portion 17 to the package. The attachment portion 17 extends radially outward from the tubular portion 16, such as perpendicular from the tubular portion 16 or at a slanted angle outward and downward from the tubular portion 16. For example, the attachment portion 17 connects to one end of the tubular portion 16, i.e. the lower end.

The neck 12 is formed with an inward projecting sealing flange 18. For example, the sealing flange 18 is arranged at one end of the tubular portion 16, such as the upper end and e.g. in the opposite end as the attachment portion 17. In the illustrated embodiment, the sealing flange 18 extends radially inward and downward from the tubular portion 16. The sealing flange 18 is arranged continuously around the entire interior circumference of the tubular portion 16 and is formed with a free end. Due to the inherent flexible properties of the material the sealing flange 18 is resiliently flexible. The cap 11 is formed with an axially extending sealing ring 19 to interact with the sealing flange 18 to form a seal between them. The sealing ring 19 projects from the interior side of the top portion 13 and forms a continuous and closed loop. For example, the sealing ring 19 is resiliently flexible due to the inherent flexible properties of the material of the package closure 10. For example, the sealing ring 19 is cylinder-shaped. The sealing ring 19 is formed with a free end. In the illustrated embodiment, an outer surface of the sealing ring 19 is formed with an optional protrusion 20 extending radially outward for interacting with the sealing flange 18. For example, the protrusion 20 is arranged beyond the sealing flange when the cap 11 is closed, wherein the protrusion 20 is arranged below the free end of the sealing flange 18.

The neck 12 is connected to the cap 11 through a folded portion 21. The folded portion 21 connects the tubular portion 16 of the neck 12 with the wall 14 of the cap 11. For example, the folded portion 21 has a first end connected to the tubular portion 16, such as the top end of the tubular portion 16, wherein an opposite second end of the folded portion 21 is connected to the wall 14, such as a bottom end of the wall 14. The folded portion 21 is formed thinner than the wall 14 and the tubular portion 16. The folded portion 21 is folded outward and is arranged between the tubular portion 16 and the wall 14. Hence, the wall 14 is arranged radially outside of the tubular portion 16. In the illustrated embodiment, the wall 14 is arranged radially outside of the folded portion 21, wherein the wall 14 encloses the folded portion 21 so that the folded portion 21 is arranged between the wall 14 and the tubular portion 16. For example, the folded portion 21 is arranged in a gap between the wall 14 and the tubular portion 16. For example, the wall 14 and the tubular portion 16 are arranged coaxially. In the illustrated embodiment, the wall 14 encloses the tubular portion 16. For example, the wall 14 is arranged with larger diameter than the tubular portion 16. The cap 11, the neck 12 and the folded portion 21 are integrated and formed in a single piece. For example, the folded portion 21 is continuous and forms a sealing between the neck 12 and the wall 14 of the cap 11.

In the illustrated embodiment, the cap 11 is formed with an optional fixing portion 22 for attachment to the package by melting or welding. For example, the fixing portion 22 extends outward from the wall 14, such as from a bottom end of the wall 14, and extends, for example, radially outward, such as perpendicular or slanted outward. The fixing portion 22 is arranged for fixing the wall 14 of the cap 11 to the neck 12 and to the package. For example, the fixing portion 22 is engaging the attachment portion 17 to be melted together with the attachment portion 17 and the package when the package closure 10 is attached to the package. Hence, the wall 14 of the cap 11 is fixed to the neck 12 and to the package by means of the fixing portion 22.

The top portion 13 of the cap 11 is connected to the wall 14 through a breakable notch 23 and a hinge 24, wherein the top portion 13 is openable by tearing along the notch 23 and folding along the hinge 24. For example, the breakable notch 23 extends around a major part of the circumference between the top portion 13 and the wall 14 and is formed by a thinner material thickness than the wall 14 and top portion 13, wherein the breakable notch 23 is interrupted by the hinge 24 extending around a small portion of said circumference and being formed by a larger material thickness than the breakable notch 23. For example, the breakable notch 23 is formed with an optional start area 25 formed by even thinner material or by another type of weakening, so that tearing along the notch 23 is initiated at the start area 25. The start area 25 is illustrated more in detail in FIGS. 3*b* and 3*c*. For example, the start area 25 is arranged opposite the hinge 24. According to one embodiment, the notch 23 is arranged so that it takes at least 20 N (Newton) to break it, such as at least 30 N or 30-60 N or 40-60 N. The hinge 24 connecting the top portion 13 to the wall 14 is arranged so that a greater force is required to bend it or to break it than the force required to break the notch 23. For example, said hinge 24 is arranged so that at least 50 N is required to bend it or to break it, such as 50-100 N or 50-80 N.

With reference particularly to FIG. 3*c* the breakable notch 23 is formed with a breakable reinforcement R on both sides of the start area 25 to form a natural short stop or pause before continuing breaking the breakable notch 23. Hence, when a person starts tearing the notch 23 by pulling the pull-ring 25 the start area 25 breaks until the reinforcements R, wherein the reinforcements R temporarily stops the tearing and requires a larger force to continue tearing the breakable notch 23. In this way, for example a higher pressure inside the package can be let out before tearing the rest of the breakable notch 23.

The pull-ring 15 is connected to the top portion 13 of the cap 11 through a hinge 26, which is illustrated more clearly in FIGS. 5-8. In FIGS. 5 and 6 the package closure 10 has been opened, at least partially, by pulling the pull-ring 15 and thereby breaking the breakable notch 23 between the top portion 13 and the wall 14. Hence, the top portion 13 forms an openable lid which can be closed again for closing and sealing the package closure 10 after it has been opened by breaking the notch 23. For example, the top portion 23 forms a lid functioning without threads, which sometimes is called a flip lid. After breaking the notch 23 the package closure 10 is sealed by means of the sealing flange 18 and the sealing ring 19. For example, the breakable notch 23 forms a tamper-proof function, wherein first-time opening or unauthorised opening of the package closure 10 can be detected. According to one embodiment, the breakable notch 23 forms a liquid-proof seal or also gas-proof seal between the wall 14 and the top portion 13 before it is broken. The hinge 26 of the pull-ring 26 is, e.g. arranged opposite the hinge 24 connecting the top portion 13 to the wall 14. In the illustrated embodiment, the pull-ring 15 is a closed loop. FIGS. 9 and 10 shows an example of a fully opened package closure 10 according to one embodiment, wherein the top portion 13 has been pulled open by bending around the hinge 24 connecting the top portion 13 and the wall 14.

With reference to FIG. 11 the package closure 10 is illustrated separately in a semi-finished state for clarity and in FIGS. 12-15 production of the package closure 10 by means of a device for producing it is illustrated schematically according to one embodiment. The device for producing the package closure 10 comprises a movable first jaw 27, a movable second jaw 28, a counterpart 29 and a tool core having an outer first tool core part 30 and an inner second tool core part 31 interacting with the jaws and the counterpart to form a mould for receiving an amount of plastic material for forming the package closure 10 as illustrated schematically in FIG. 12. The device further comprises a movable ejector 32 for ejecting the produced package closure 10 and optionally also forming it. The device is arranged as a moulding tool for moulding plastic materials. For example, the device or parts thereof can be heated and cooled in a conventional manner.

The outer first tool core part 30 is arranged for forming the interior side of the tubular portion 16 of the neck 12. The outer first tool core part 30 is also arranged for forming the sealing flange 18, one side of a foldable portion (to be the folded portion) 21 and the interior side of the wall 14 of the cap 11. Hence, the outer first tool core part 30 is arranged for forming the wall 14 with greater inner diameter than the inner diameter of the tubular portion 16 of the neck 12. The outer first tool core part 30 is arranged for forming the foldable portion 21 between the wall 14 and the tubular portion 16 and e.g. with an inclined angle outward and upward. For example, the outer first tool core part 30 is arranged for forming the breakable notch 23 and the hinge 24 connecting the top portion 13 and the wall 14. In the illustrated embodiment, the outer first tool core part 30 is also arranged for forming an outer side of the sealing ring 19. The second inner tool core part 31 is arranged for forming the interior side of the top portion 13 and an interior side of the sealing ring 19.

With reference to FIG. 13 the jaws 27, 28 and the counterpart 29 have been removed from the moulded and semi-finished package closure 10 and the outer first tool core part 30 has been displaced axially in relation to the inner second tool core part 31 to be disengaged from the package closure 10. Hence, the outer first tool core part 30 is movable in relation to the inner second tool core part 31. The end part of the outer first tool core part 30 for forming the interior of the wall 14 has been forced to pass the more narrow tubular portion 16 and the sealing flange 18, wherein the tubular portion 16 and the sealing flange 18 temporarily are expanded. When the outer first tool core part 30 has passed the more narrow tubular portion 16 and the sealing flange 18 they regain their original shape due to the inherent resilient flexible properties of the material and the material e.g. still being soft and warm from the moulding process. In the illustrated embodiment, the outer first tool core part 30 is arranged also for forming a part of the attachment portion 17. Alternatively, the tubular portion 16 is inclined outward toward the attachment portion 17. Alternatively, the attachment portion 17 is formed by another tool part, such as the jaws 27, 28. When the outer first tool core part 30 is displaced in relation to the inner second tool core part 31, the latter is engaging the package closure 10. Then, the inner second tool core part 31 is displaced axially in relation to the ejector 32, wherein the cap 11 is displaced axially in relation to the neck 12 under folding of the foldable portion 21 to its folded position as illustrated in FIG. 14. For example, the foldable portion 21 is folded without breaking, so that the folded portion 31 is intact and provides a sealing function of the finished package closure 10. The cap 11 is formed with a projection 33, such as a flange or similar, for engaging the inner second tool core part 31 during displacement of the cap 11 in relation to the neck 12. For example, the projection 33 is formed to provide a greater holding force than the force required to fold the folded portion 21 during displacement of the cap 11 in relation to the neck 12, so that the inner second tool core part 31 is kept engaged to the top portion 13 and the inner side of the sealing ring 19 during said displacement. For example, the projection 33 is arranged on the sealing ring 19, such as on the inner side of the sealing ring 19. In the illustrated embodiment, the projection 33 projects radially inward. The cap 11 is displaced in relation to the neck 12 to provide the finished and closed package closure 10, e.g. as described above with reference to FIGS. 1-4. For example, the cap 11 is displaced in relation to the neck 12 until the cap 11 engages the neck 12, such as until the top portion 13 engages the neck 12 and/or the optional fixing portion 22 engages the attachment portion 17. Then, the finished package closure 10 is disengaged from the inner second tool core part 31 by means of the ejector 32 as illustrated in FIG. 15, wherein the package closure 10 and the ejector 32 are displaced axially in relation to the inner second tool core part 31, so that the projection 33 is disengaged from the inner second tool core part 31 by the inherent resilient flexible properties of the material.

With reference to FIGS. 16-21 a package closure 40 is illustrated according to another embodiment. FIGS. 16-18 illustrate the package closure 40 and FIGS. 19-21 illustrate the package closure 40 mounted on a package 41 having a neck 42. For example, the package closure 40 is arranged to be fitted on a package 41 in the form of a bottle, such as a plastic bottle, for closing an opening of the neck 42 thereof. For example, the package closure 40 is formed as a cap in a single integrated piece of plastic material, such as thermoplastic material, e.g. by moulding.

The package closure 40 comprises a centre axis X a radially extending top portion 43, an axially extending wall 44 and a folded portion 45. For example, the package closure 40 is formed substantially with circular cross section. Alternatively, the package closure 40 is formed with oval, rectangular or triangular cross section, e.g. with rounded corners if applicable. The package closure 40 is formed with a sealing ring 46 extending axially from the interior side of the top portion 43 and being provided with a radially outward projecting sealing flange 47 for engaging and sealing against the interior side of the neck 42 when the package closure is in its closed position. In the illustrated embodiment, the sealing flange 47 is arranged at an end, such as the lower end, of the sealing ring 46. The sealing ring 46 and the sealing flange 47 are continuous and formed as a closed loop. The sealing ring 46 is arranged within the wall 44, wherein the wall 44 encloses the sealing ring 46. For example, the sealing ring 46 extends substantially in parallel to the wall 44.

The top portion 43 is connected to the wall 44 through the breakable notch 23, optionally with the start area 25, and the hinge 24 as describe above with reference to the embodiment of FIGS. 1-15. The package closure 40 is also formed with the pull-ring 15 as described above with reference to the embodiment of FIGS. 1-15. The package closure 40 according to the embodiment of FIGS. 16-21 differs from the package closure 10 according to the embodiment of FIGS. 1-15 mainly in the absence of the neck as part of the package closure and that the sealing ring 46 is formed with the sealing flange 47. Hence, also the device for producing the package closure 40 is similar, however simplified as the neck does not have to be formed. For example, the package closure 40 is also formed by a device having inner and outer tool core parts similar to the embodiment described above, wherein the package closure 40 is held in place by the projection 33 engaging the inner tool core part when a foldable portion is folded to the folded portion 45. Alternatively, the foldable portion is folded to the foldable portion 45 in a separate step by a separate device. In such a case a one-piece tool core can be used, provided that the folded portion 21 is not to be formed as described below with reference to FIGS. 26 and 27.

According to the embodiment of FIGS. 16-21 the folded portion 45 is connected to an end of the wall 44 opposite the top portion 43 and is folded inward and upward to form a locking function together with a protrusion 48 on the exterior side of the neck 42, such as a flange or similar. The folded portion 45 is resiliently flexible by the inherent properties of the material and can be pushed over and beyond the protrusion 48 and then spring back to form the locking function. Hence, the package closure 40 cannot be unintentionally removed from the package 41 after being mounted thereon. Also, the package closure 40 is formed in one integral piece of plastic material without any loose or detachable parts. According to one embodiment, the hinge 24 of the top portion 43 and, optionally also the hinge 26 of the pull-ring 15, are arranged so that the pull-ring 15 and/or top portion 43 cannot be removed unintentionally or broken easily to avoid parts coming loose from the package closure and to achieve that the package closure 40 stay as one integral piece also after use.

With reference particularly to FIGS. 20 and 21 the package 41 with the package closure 40 is illustrated according to one embodiment. In FIG. 20 the package closure 40 is illustrated with neutral pressure inside the package 41, whereas in FIG. 21 the package closure 40 is illustrated with an elevated pressure inside the package 41, wherein the pressure inside the package 41 is larger than the pressure outside. For example, the pressure inside the package 41 is increased due to the content of the package 41, such as due to carbonated liquids, or changes in temperature, etc., wherein the inside of the top portion 43 is subject to a force directed substantially axially, such as upward, which is illustrated schematically in FIG. 21 by means of the arrow F. When the pressure is increased inside the package 41 the sealing ring 46 is pressed radially outward toward the inside of the neck 42, which can increase the sealing effect even more. Also, to further improve the sealing effect, the package closure 40 in the illustrated embodiment is formed with a lever ring 49 connected to the sealing ring 46 through a leverage line 50 to increase the radially outward force when the top portion 43 is subject to the axial force F due to increased pressure inside the package 41. The lever ring 49 connects the top portion 43 and the sealing ring 46, wherein the wall 44 is connected to the leverage line 50 through a radially extending portion 51. For example, the lever ring 49 extends substantially in the axial direction and is, e.g. aligned with the sealing ring 46. In the illustrated embodiment, the radially extending portion 51 is arranged substantially perpendicular to the sealing ring 46 and the lever ring 49. For example, the projection 33 as described above, is arranged at the leverage line 50. Hence, the lever ring 49, sealing ring 46 and the connection to the wall 44 through the radially extending portion 51 form the leverage line 50, so that when the top portion 43 is subject to the force F the lever ring 49 is inclined inward while the sealing ring 46 will be forced radially outward. The lever ring 49 and the sealing ring 46 are thus forced around the leverage line 50 formed by the radially extending portion 51 leading to the wall 44 to provide improved sealing when the pressure inside the package 41 is high, such as due to a carbonated liquid content. For example, the radially extending portion 51, and optionally the projection 33, and the wall 44 form a more rigid structure, particularly when the package closure 40 is mounted on a package 41, than the lever ring 49 and the sealing ring 46, so that they can pivot around the leverage line 50 in the connection to the radially extending portion 51 when the pressure inside the package 41 is increased and the top portion 43 is subject to the force F. It is believed that the top portion 43 will arch outward due to the force F, wherein the lever ring 49 on one side of the leverage line 50 will be forced inward and the sealing ring 46 on the other side of the leverage line 50 will be forced outward. As understood, the package closure 10 according to the embodiments described above with reference to FIGS. 1-15 is for example formed with the lever ring 49 and the radially extending portion 51 to provide the leverage line 51 and the leverage around the leverage line 50 due to increased pressure inside the package in a similar manner.

With reference to FIGS. 22 and 23 the notch 23 with the start area 25 and the reinforcements R as described with reference to FIG. 3*c* are illustrated according to one embodiment. The view is a section view at the notch 23 and seen toward the top portion 43. The embodiment of FIGS. 22 and 23 is applicable to the embodiments illustrated in FIGS. 1-15 as well as the embodiments illustrated in FIGS. 16-21. The notch 23 extends between the top portion 43 and the wall 44, wherein the top portion 43 is connected to the wall 44 by means of the hinge 24 after tearing along the notch 23. Hence, the top portion 43 is attached to the wall and can be turned around the hinge 43 after breaking the notch 23. In the illustrated embodiment, the start area 25 is formed as a cut, such as a pointed cut, so that pulling the pull-ring 15 will result in that the notch 23 is broken first in the start area 25. The breakable reinforcements R are arranged on both sides of the start area 25, such as a short distance from it. For example, the reinforcements R are arranged 2-5 mm from the start area 25. The reinforcements R are formed as thicker portions of material in the notch 23 so as to temporarily stop breaking thereof due to a person tearing it by pulling the pull-ring 15 as described above with reference to FIG. 3*c*.

With reference to FIGS. 24 and 25 another embodiment of the package closure 10 is illustrated. The package closure 10 of FIGS. 24 and 25 is formed in a similar manner as described above with reference to FIGS. 11-15 and similar features as described above are indicated with the same reference signs. The package closure of FIGS. 24 and 25 comprises the attachment portion 17 is thus arranged for attachment to a package, such as a carton or similar, by melting or welding a part of the attachment portion 17 to the package as described above. In addition to the embodiment of FIG. 3 the package closure of FIGS. 24 and 25 is formed with first and second locking protrusions 34*a*, 34*b*, wherein the first locking protrusion 34*a* engages the second locking protrusion 34*b* when the cap 11 is displaced in relation to the neck 12 during manufacturing of the package closure 10 as described above with reference to FIGS. 13-15. Hence, the folded portion 21 is provided with the first locking protrusion 34*a*, wherein the tubular portion 16 of the neck 11 is provided with the second locking protrusion 34*b*. During forming in the mould, the first and second locking protrusions 34*a*, 34*b* are projecting radially outward, as illustrated in FIG. 24, wherein the first locking protrusion 34*a* is arranged between the top portion 13 and the second locking protrusion 34*b*. For example, the first and second locking protrusions 34*a*, 34*b* are formed by the jaws 27, 28 of the tool forming the mould. After displacing the neck 11 in relation to the cap 11, the folded portion 21 is folded, so that the first locking protrusion 34*a* projects radially inward to engage the second locking protrusion 34*b* and lock the cap 11 to the neck 11 in the displaced position as illustrated in FIG. 25, wherein the second locking protrusion 34*b* is placed between the top portion 13 and the first locking protrusion 34*a*. In the embodiment of FIGS. 24 and 25 the fixing portion 22 is optional.

Also, to further improve the sealing effect, the package closure 10 according to all embodiments may be formed with the lever ring 49 connected to the sealing ring 19 through the leverage line 50 to increase the radially outward force when the top portion 13 is subject to the axial force F due to increased pressure inside the package 10 as described above with reference to FIG. 21.

A package comprising the package closure 10 having the attachment portion 17 according to any of the embodiments described herein is attached to the package closure e.g. by welding or melting at least a part of the attachment portion 17 to the package, wherein the fixing portion 22 is welded to or melted together with the attachment portion 17, so that the wall 14 of the cap 11 is fixed to the attachment portion 17.

With reference to FIGS. 26 and 27 another embodiment of the package closure 10 is illustrated. The package closure 10 of FIGS. 26 and 27 is formed in a similar manner as described above with reference to FIGS. 11-15 and similar features as described above are indicated with the same reference signs. The package closure of FIGS. 26 and 27 comprises both the folded portion 21 and the resiliently flexible folded portion 45 for locking the package closure 10 to the package 41, such as a bottle or other type of package, having the protrusion 48 as described above. Also, the package closure 10 of FIGS. 26 and 27 is formed with the first and second locking protrusions 34*a*, 34*b*.

The invention claimed is:

1. A method for producing a package closure having an axis, a neck, a cap and a folded portion connecting the neck and the cap, comprising the steps of a) by means of movable jaws, a counterpart, an outer first tool core part and an inner second tool core part forming the neck the cap and a foldable portion connecting the neck and cap in a single integrated piece, wherein an interior of the neck, an inward projecting sealing flange of the neck, an interior of the foldable portion and an interior of a wall of the cap are formed by the outer first tool core part, wherein an interior of a top portion of the cap and an interior of a sealing ring of the cap is formed by the inner second tool core part, and wherein a breakable notch and a hinge are formed between the top portion and the wall of the cap by the movable jaws and the outer tool core part, b) removing the jaws from the formed package closure, c) axially displacing the first tool core part in relation to the second tool core part, thereby disengaging the cap from the first tool core part while keeping the second tool core part engaged with the cap, d) displacing the neck axially in relation to the cap while folding the foldable portion to the folded portion through an inherent flexibility of the package closure, wherein the wall is brought to enclose a tubular portion of the neck and the sealing ring is engaging the sealing flange, e) displacing the package closure in relation to the second tool core part to disengage the package closure from the second tool core part.

2. The method of claim 1, comprising the step of forming the cap with a pull-ring connected to the top portion of the cap through a hinge.

3. The method of claim 1, comprising the step of forming an outer surface of the sealing ring with a radially outward extending protrusion arranged beyond the sealing flange when the cap is closed.

4. The method of claim 1, comprising the step of forming a flexible projection extending radially inward for maintaining the cap engaged with the second tool core part during axial displacement of the neck in relation to the cap.

* * * * *